US010440988B2

(12) United States Patent
Alvez et al.

(10) Patent No.: US 10,440,988 B2
(45) Date of Patent: Oct. 15, 2019

(54) HUMIDIFICATION APPARATUS

(71) Applicant: CIGAR LABS INC., Toronto (CA)

(72) Inventors: Edmond Li Alvez, Toronto (CA); Thomas Edward Mikkola, Toronto (CA)

(73) Assignee: CIGAR LABS INC., Toronto, Ontario (CA)

( * ) Notice: Subject to any disclaimer, the term of this patent is extended or adjusted under 35 U.S.C. 154(b) by 259 days.

(21) Appl. No.: 15/673,750

(22) Filed: Aug. 10, 2017

(65) Prior Publication Data

US 2019/0045842 A1 Feb. 14, 2019

(51) Int. Cl.
*F24F 6/12* (2006.01)
*A24F 25/02* (2006.01)

(52) U.S. Cl.
CPC ..... *A24F 25/02* (2013.01); *F24F 6/12* (2013.01)

(58) Field of Classification Search
CPC ..... A24F 25/02; F24F 6/12
USPC ..... 261/78.2, 81
See application file for complete search history.

(56) References Cited

U.S. PATENT DOCUMENTS 4,790,479 A * 12/1988 Matsumoto ..... A61M 15/0085 128/200.16
7,490,815 B2 * 2/2009 Tollens ..... B05B 17/0646 261/30
7,547,004 B2 * 6/2009 Hsu ..... F24F 6/02 261/104
7,654,508 B2 * 2/2010 Wegner ..... F24F 6/14 261/34.1
9,586,228 B2 * 3/2017 Roemburg ..... A61L 9/127
2003/0042629 A1 * 3/2003 Eom ..... F24F 6/12 261/81
2013/0168880 A1 * 7/2013 Duke ..... A24F 47/008 261/78.2
2016/0213866 A1 * 7/2016 Tan ..... A61M 11/005
2017/0274405 A1 * 9/2017 Lucas ..... B05B 17/0646

* cited by examiner

*Primary Examiner* — Charles S Bushey
(74) *Attorney, Agent, or Firm* — Bacon & Thomas, PLLC

(57) ABSTRACT

The present invention is a humidification apparatus including a water reservoir for accommodating water; a housing and a coupler, wherein the housing includes sensors for detecting humidity and temperature in surrounding environment, a transducer for generating high frequency oscillation to atomize water in contact therewith, and a control circuitry for activating the transducer to generate high frequency oscillation; and the coupler has two ends removably coupled to the water reservoir and the housing, respectively, and includes a vertical passage, at least one horizontal passage intersected therewith and a wicking element inserted in the vertical passage with its lower end receiving water from the water reservoir through the horizontal passage, top end of the vertical passage communicates with the surrounding environment through an outlet of the housing; such that wicking element is able to continuously absorb water and let top end thereof always be moistened while in contact with the transducer.

42 Claims, 6 Drawing Sheets

HUMIDIFICATION APPARATUS

FIELD OF THE INVENTION

The invention relates to a humidifier, more particularly to a humidification apparatus for producing humidifying mist or vapor and then conveying the same into an enclosed environment inside a humidor.

BACKGROUND OF THE INVENTION

A conventional humidor may be any kind of box or room with constant humidity that is used for storing and taking good care of the humidity of cigars, cigarettes, pipe tobacco, or tobacco within an enclosure of the humidor. For private use, small wooden boxes for holding a few dozen cigars are very common, while some cigar shops may have a walk-in humidor. Humidors can also be used for maintaining other goods to have consistent and desired humidity level. Many humidors use hygrometers therein to monitor their humidity levels, respectively.

Commercially made humidor cases are typically made of wood, although other materials, like acrylic glass and metal, are not uncommon. Carbon fibre, silicon carbide, and polyethylene have also been used. Disregarding the aesthetic qualities, the casing's primary purpose is to protect the interior thereof and create a closed environment, so any durable and airtight material can be used. Typically, the interior of a conventional humidor case is overlaid with a veneer of Spanish cedar, which possesses the following desirable characteristics for cigar storage:

It holds more moisture than most woods, so it helps maintain humidity of the environment inside the humidor case;

It is not prone to "warping" or "cupping" in high humidity;

It imparts its aroma to cigars; For the same reason, some cigars are wrapped in Spanish-cedar sheets before they are sold; and It can repel tobacco beetles, pinhead-sized pests which can ruin entire stocks of cigars by eating the tobacco and laying eggs, causing further infestation. They can also be discouraged by ensuring the temperature inside the humidor not getting hotter than 20° C. (68° F.). The beetle eggs usually only hatch at around 25 C (77 F), although there are also instances where they will hatch at cooler temperatures if the humidity is too high.

In general, Humidors are typically commercially produced, though most walk-ins are custom built and some humidors are homemade. They range considerably in material, size and complexity. Capacity of the Humidor is usually determined by deducting the space required for the humidification element and some extra room between the humidification element and the cigars. It can also be calculated online for the most popular cigar formats.

In order to maintain the humidity of the tobacco or cigars to a favorable and desirable level, the tobacco and cigars are usually placed in an enclosure such as a humidor which has an interior constructed of wood along with some form of humidifier for the purpose of providing protection to the tobacco and cigars by creating an environment within the enclosure of the humidor which promotes and maintains the relative humidity inside the humidor to a certain level usually within 65% to 75% relative humidity. This process may take a long time and usually requires a User's involvement through periodically opening the enclosure for checking whether or not the relative humidity level inside the humidor is maintained to a desirable level.

As to the humidity inside the conventional humidor, low relative humidity will inevitably cause many problems including causing the tobacco becoming brittle and dehydrated as well as having tears on cigar wrappers, which eventually increases stiffness of the tobacco and in turn causes the tobacco losing its original flavor due to the absence of moisture and natural oils within the tobacco that are produced when properly humidified. Conventionally, in order to effectively overcome the problems mentioned above, humidifiers currently installed in ordinary humidors include a water-absorbing pad along with a fixed electric fan that provides airflow over the water-absorbing pad to increase the humidity inside the humidor over a period of time. Other types of humidifiers may include only a moistened pad, sponge or water beads situated inside the humidor until all moisture within the humidifier is depleted via natural evaporation. A third form of humidification requires a package of premixed water and salt formula placed inside the enclosure of the humidor that helps to regulate the relative humidity inside the enclosure and is replaced once the content of the package is dried out.

In view of the above, it should be apparent and obvious that the conventional humidifying methods are unable and fail to create an optimal environment for the contents stored inside the humidor due to various reasons such as the relatively low flow rate provided therein for dispersing the humid air into the enclosure of the humidor, which takes a long period of time to increase the relative humidity of the air in the internal environment of the humidor to reach a desirable level because the humidity being created by these types of conventional humidifiers are quickly absorbed by the naturally absorbent tobacco as well as the wooden materials used in the interior construction of the humidor faster than conventional humidifiers can introduce new moist air into the enclosure of the humidor. Therefore, although the conventional humidifiers currently existing in the market have achieved considerable popularity and commercial success, there has been a continuous need to improve on the capabilities offered by these conventional humidifiers.

Accordingly, a need arose to design a whole new humidifier (hereinafter referred to as "humidification apparatus") for being used in a humidor so that, when a User places the cigars, cigarettes, pipe tobacco, tobacco or other goods within an enclosure of the humidor, the configurations and mechanism of the humidification apparatus not only will effectively improve the humidity introduction rate thereof, but also will avoid the User from getting involved in the maintenance of the humidity inside the enclosure of the humidor, as well as effectively reducing the amount of moving parts of the apparatus to zero, and in turn effectively reducing the amount of parts required in manufacturing, assembling, and using the apparatus, thereby allowing the apparatus to be in a preferred smaller package capable of being conveniently placed in almost any size humidor and continuously maintain the relative humidity inside the said enclosure to a desirable level.

SUMMARY OF THE INVENTION

In view of the drawbacks of the aforesaid conventional humidifiers in terms of performance, portability, and utility, the disclosed configurations and mechanisms of the new humidification apparatus are intended to solve the aforementioned drawbacks with greater ease of use, higher accuracy, higher stability, and greater utility so as to promote and maintain humidity inside a humidor, achieving consistent and desirable humidity levels far more suitable for storing cigars, cigarettes, tobacco, or other goods than its prior art counterparts.

It is an objective of the present invention to provide a humidification apparatus which, may comprise of multiple interconnected segments that couple together to form an elongated body including a water reservoir, a housing, a high frequency transducer, control circuitry and a coupler: wherein the water reservoir has an open end and a closed end, and a first accommodating space formed therein between the two ends for receiving a volume of water; the housing has a second accommodating space formed therein, wherein a humidity sensor and a temperature sensor are disposed in the housing for sensing humidity and temperature of the surrounding environment of the apparatus, an electronic display is disposed on the body of the housing for displaying digital numeric values of identified setpoints of humidity and temperature values respectively; a plurality of power connectors are disposed on symmetrical and opposing positions inside the housing for supplying power therethrough from a power source to electronic elements of the apparatus, and at least one User operable button is disposed on the body of the housing for allowing a User to set or adjust the setpoints of humidity and temperature values as well as to provide an access to a selectable menu items shown on the electronic display; the high frequency transducer is disposed inside the housing and is able to generate a high frequency oscillation thereon for atomizing water in contact therewith; at least one control circuit is disposed within the second accommodating space and is electrically connected to the electronic display, the User operable buttons, and the sensors, respectively. and is able to activate the high frequency transducer to generate the high frequency oscillation in response to the humidity or temperature value changes detected by the sensors and to act as an atomizing device for producing humidifying mist or vapor; and the coupler has one end removably coupled to the open end of the water reservoir by means of a watertight connection, and another end removably coupled to a first end of the housing, and the coupler includes at least one horizontal passage and a vertical passage formed therein and a wicking element, wherein the vertical passage is configured to intersect with the horizontal passage, and the horizontal passage is configured for creating a continuously regulated flow of water from the first accommodating space of the water reservoir to the vertical passage, wherein a wicking element is inserted in the vertical passage with its lower end positioned within the coupler corresponding to the intersection of the vertical passage and the horizontal passage for receiving liquid flowing from the first accommodating space to the coupler through the horizontal passage, and with its upper end protruding above and out the vertical passage and being in contact with the base of the high frequency transducer, such that the wicking element is able to continuously absorb said liquid and then consistently move said liquid upwards against gravity by capillary action through the wicking element to the upper end of the wicking element so that the top end of the wicking element is not only always located at a position in contact with the base of the high frequency transducer, but is also always moistened by said liquid.

It is another objective of the present invention to provide a humidification apparatus of which the coupler further comprises an extruded lower end that can be coupled to the an oppositely extruded upper end formed on the housing, so that the extruded lower end of the coupler can then be merged with the oppositely extruded upper end of the housing together to form a continuously circumferential elongated body, wherein the upper end of the wicking element protruding out from the coupler through the vertical passage may be in contact with the base of the high frequency transducer situated inside the housing corresponding to an outlet formed on the housing, such that when the high frequency transducer is activated by the control circuitry, in response to the humidity changes detected by the sensors, the transducer will generate a high frequency oscillation and, in the meantime, apply the high frequency oscillation to the liquid contained in the upper end of the wicking element, the liquid will be atomized to become a humidifying mist or vapor and to be dispersed through the outlet out to the surrounding environment.

BRIEF DESCRIPTION OF THE DRAWINGS

Several preferred embodiments of the present invention will now be described, by way of examples with reference to the accompanying drawings, in which.

DETAILED DESCRIPTION OF THE INVENTION

The present invention will now be described in detail hereinafter by reference to certain embodiments thereof as illustrated in the accompanying drawings. In the following detailed description, numerous specific details are set forth in order to provide a thorough understanding of the present invention. However, it will be apparent to those who are skilled in the art, that the present invention may be practiced without having some of these specific details. In other instances, well known details have not been described in detail hereinwith in order not to unnecessarily obscure the essential and core features of the present invention.

Figure 1:
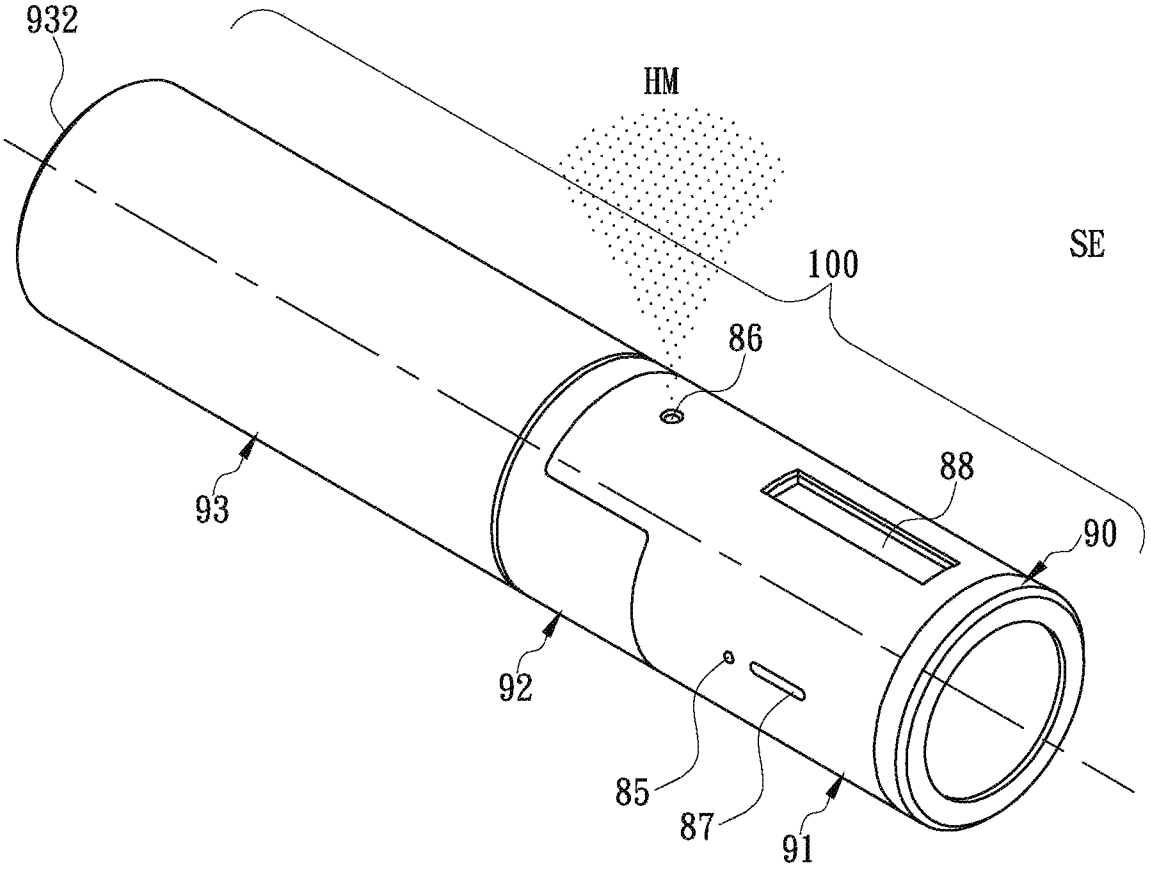
FIG. 1 is a perspective view of a first preferred embodiment of the humidification apparatus of the present invention.
Figure 2:
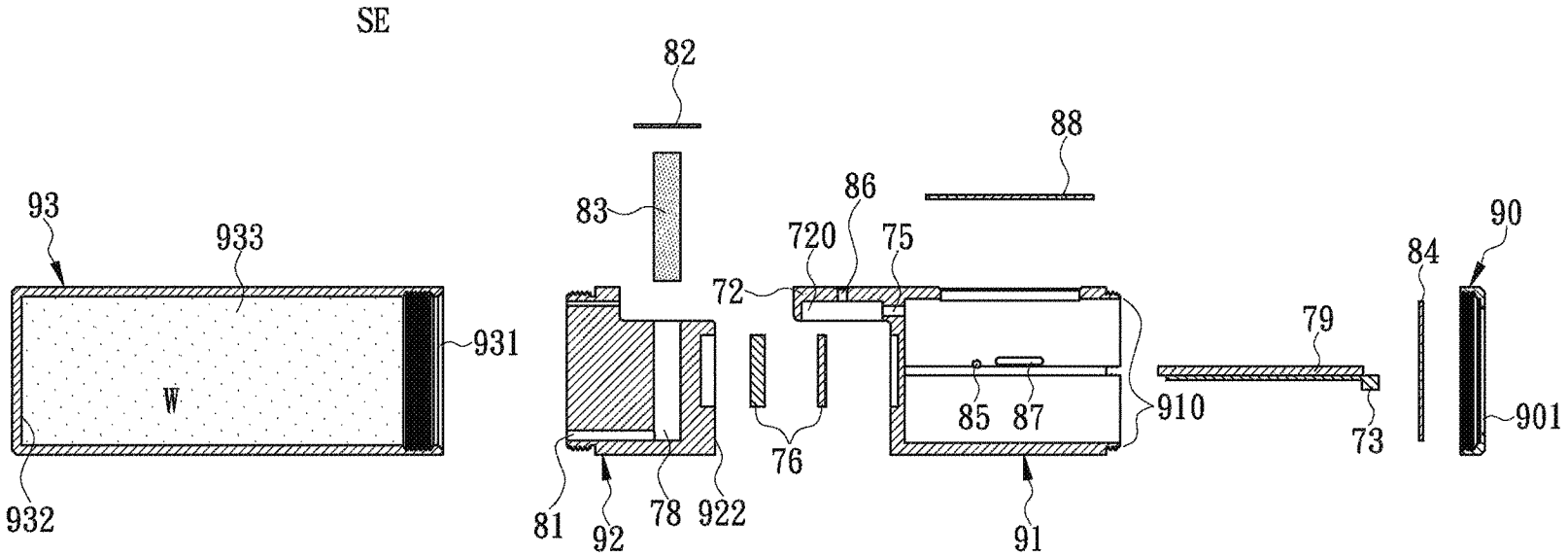
FIG. 2 is a side cross-sectional and exploded view along a longitudinal axis of the humidification apparatus of the present invention illustrated in FIG. 1.
Figure 3:
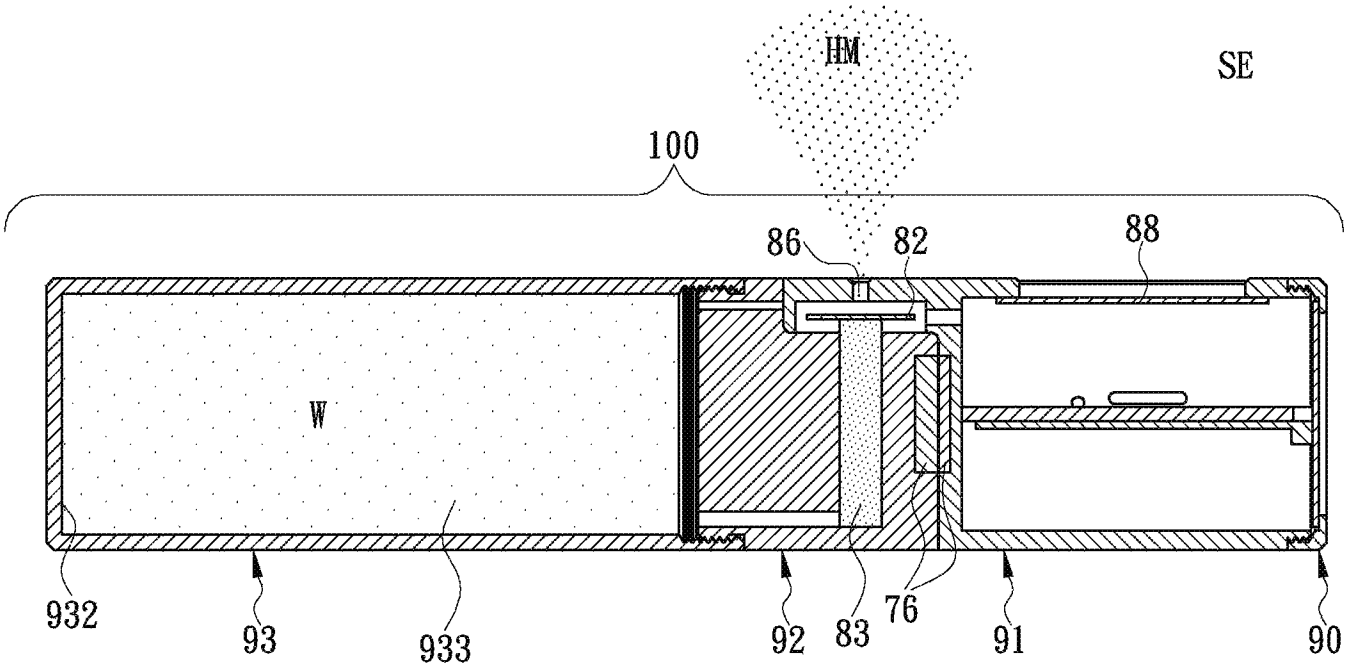
FIG. 3 is a side cross-sectional view along a longitudinal axis of the humidification apparatus of the present invention illustrated in FIG. 1.

According to one or more embodiments of the present invention, a first preferred embodiment of the present invention is a Humidification apparatus (100) for being placed in an enclosed environment inside a humidor and illustrated respectively in FIGS. 1, 2 and 3, which may comprise multiple interconnected segments that couple together to form an elongated body including a water reservoir (93); a housing (91); a high frequency transducer (82); a control circuitry (79); a coupler (92): wherein the water reservoir (93) has an open end (931) and a closed end (932), and a first accommodating space (933) formed therein between the two ends (931), (932) for receiving a volume of water (W); the housing (91) has a second accommodating space (910)

formed therein, wherein a humidity sensor and a temperature sensor (not shown) are disposed in (inside or outside) the housing (91) for detecting humidity and temperature in a surrounding environment (SE) of the apparatus (100); an electronic display (88) is disposed on outside body of the housing (91) for displaying digital numeric values of identified setpoints of humidity and temperature values respectively; a plurality of power connectors (87) are disposed on symmetrical and opposing positions inside or outside the housing (91) for supplying power therethrough from a power source (such as an outlet or an internal power source like a battery installed to the apparatus (100) or an external power source installed outside the apparatus (100) to electronic elements of the apparatus (100); at least one User operable button (85) is disposed on the outside body of the housing (91) for allowing a User to set or adjust the setpoints of humidity and temperature values as well as to provide an access to a selectable menu items shown on the electronic display (88); the high frequency transducer (82) is disposed inside the housing (91) and is able to generate a high frequency oscillation thereon for atomizing water in contact therewith; the control circuitry (79) is disposed within the second accommodating space (910) and is electrically connected to the electronic display (88); the User operable button (85), the power connectors (87) and the sensors, respectively, and is able to activate the high frequency transducer (82) to generate high frequency oscillation in response to the humidity values and changes detected by the sensors and to act as an atomizing device for producing humidifying mist or vapor (HM); and the coupler (92) has one end removably coupled to the open end (931) of the water reservoir (93) by means of a watertight connection, and another end removably coupled to a first end of the housing (91) by means of a magnet (76) (which may include a magnet disk and a metal disk made of magnetic material, or two magnet disks, capable of attracting together with each other) for enabling the User to refill water (W) into the first accommodating space (933) of the water reservoir (93) or to do maintenance with respect to the electronic elements (such as the control circuitry (79), the frequency transducer (82), at least one User operable button (85), . . . etc.) installed inside the housing (91) or the elements formed or installed inside the coupler (92).

In other embodiment of the present invention, the apparatus (100) or the control circuitry (79) may further includes wireless circuitry (73) for wirelessly transmitting the humidity and temperature data detected by the sensors from the apparatus (100) or the control circuitry (79) to Internet connected equipment for effectively eliminating the loss of the humidity that is in the enclosed environment (SE) should the humidor have been opened by a User to manually check.

Again referring to FIGS. 1, 2 and 3, in the first preferred embodiment of the present invention, the housing (91) further comprises an outlet (86) formed thereon for conveying the humidifying mist or vapor (HM) produced by the transducer (82) from the coupler (92) out into the surrounding environment (SE); and a wire pass (75) formed thereon at a position adjacent to the outlet (86) for allowing the high frequency transducer (82) to be positioned inside the housing (91) as well as allowing the high frequency transducer (82) to be connected with the control circuitry (79).

Again referring to FIGS. 1, 2 and 3, in order to achieve the primary objective of the present invention for always maintaining the humidity inside an enclosure of the humidor to be in a consistent and desirable level, in the first preferred embodiment of the present invention, the coupler (92) further includes at least one horizontal passage (or duct) (81) and a vertical passage (or duct) (78) formed therein, and a wicking element (83); wherein the vertical passage (78) is configured to intersect with the horizontal passage (81); the horizontal passage (81) is configured for creating a continuously regulated flow of water (W) from the first accommodating space (933) of the water reservoir (93) to the vertical passage (78); and the wicking element (83) is inserted in the vertical passage (78) with its lower end positioned within the coupler (92) corresponding to the intersection of the vertical passage (78) and the horizontal passage (81) for receiving liquid (W) flowing from the first accommodating space (933) of the water reservoir (93) to the vertical passage (78) of the coupler (92) through the horizontal passage (81) such that the wicking element (83) is able to continuously absorb said liquid (W) and then consistently move said liquid (W) upwards against gravity by the capillary action of the wicking element (83) to the upper end of the wicking element (83). In addition, since the upper or top end of the wicking element (83) is protruded out and above the vertical passage (78) it is able to be in contact with the base of the high frequency transducer (82) so that the upper or top end of the wicking element (83) is not only always located at a position being in contact with the base of the high frequency transducer (82), but is also always moistened by said liquid (W) received from the water reservoir (93).

Referring to FIGS. 1~3, 4, 5 and 6, In some embodiments of the present invention, the coupler (92) may further comprise an extruded lower end (922) that can be mated to an oppositely extruded upper end (72) formed on the first end of the housing (91), so that the extruded lower end (922) of the coupler (92) can then be coupled and merged with the oppositely extruded upper end (72) of the housing (91) together to form a continuously circumferential elongated body, and the upper end of the wicking element (83) protruding out from the coupler (92) through the vertical passage (78) is then able to be in contact with the base of the high frequency transducer (82) installed in the housing (91) at the position corresponding to the outlet (86) formed on the oppositely extruded upper end (72) of the housing (91), such that when the high frequency transducer (82) is activated by the control circuitry (79), in response to the humidity values and changes detected by the sensors, the transducer will generate a high frequency oscillation and, in the meantime, apply the high frequency oscillation to the liquid contained in the upper end of the wicking element (83), the liquid will be atomized to produce humidifying mist or vapor (HM) and be dispersed through the outlet (86) out to the surrounding environment (SE), accordingly.

In some other embodiments of the present invention, again referring to FIGS. 2, and 3, the corresponding two mating ends of the coupler (92) and housing (91) that coupled and merged together into a continuously circumferential body may be held together in the form of a magnet (or magnets) (76), so as to allow a User to easily separate the housing (91) from the coupler (92) for repairing or doing maintenance with respect to the elements installed inside the housing (91) or separate the water reservoir (93) from the coupler (92) for refilling water (W) into the water reservoir (93).

In still some other embodiments, as again referring to FIGS. 2, 3 and 4, the humidification apparatus (100) claimed in the present invention may include a housing (91) compartmentally formed with two separate second accommodating spaces (910) at a second end thereof for receiving the control circuitry (79) and the wireless circuitry (73) therein, respectively, and the oppositely extruded upper end (72) of the housing (91) formed at the first end of the housing (91)

comprising a disk shaped cavity (720) facing downwardly, where the high frequency transducer (82) can be mutually configured to "press-fit" into said disk shaped cavity (720) such that the high frequency transducer (82) is positioned with its base in contact with the top end of the wicking element (83) protruding out and above the top end of the vertical passage (78), so as to ensure that, when the high frequency transducer (82) is activated by the control circuitry (79), in response to the humidity or temperature value changes detected by the sensors, will generate the high frequency oscillation, and, in the meantime, applying the high frequency oscillation directly to the liquid contained in the upper end of the wicking element (83), thereby enabling the liquid to be atomized by the high frequency oscillation for producing humidifying mist or vapor (HM) and be dispersed through the outlet (86) out to the surrounding environment (SE); wherein the outlet (86) is situated at a position corresponding to the vertical passage (78) and centered to the high frequency transducer (82) which enables the humidifying mist or vapor (HM) to be dispersed from the apparatus (100) out to the surrounding environment (SE) away from the floor or other surface upon which the apparatus (100) is located so as to effectively prevent the humidifying mist or vapor (HM) from building up water on the surface of the apparatus (100).

Figure 4:
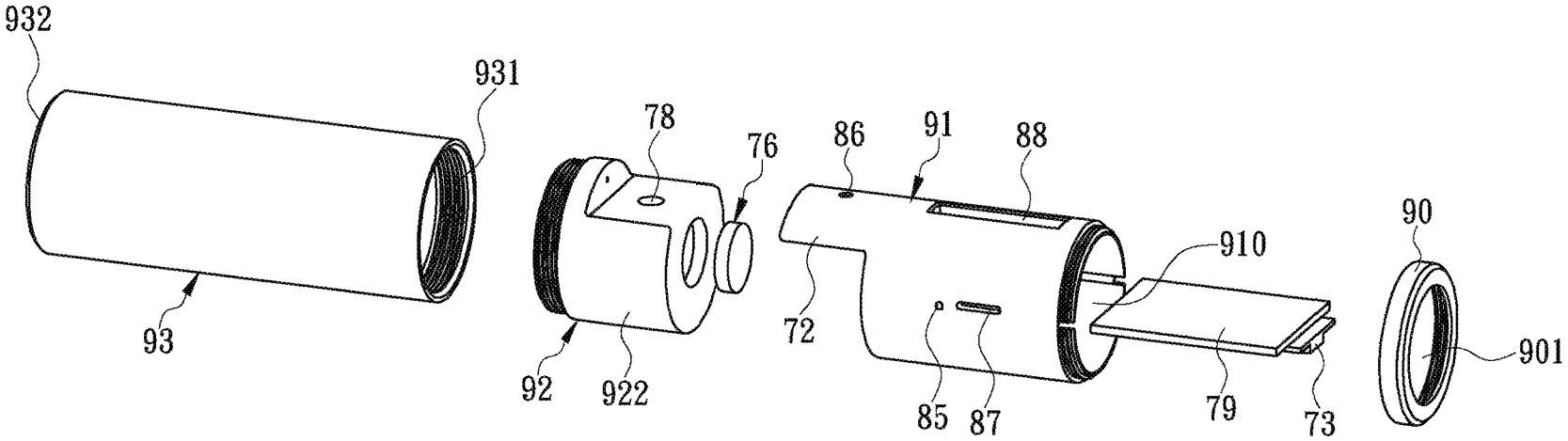
FIG. 4 a perspective side exploded view of the humidification apparatus of the present invention illustrated in FIG. 1.
Figure 5:
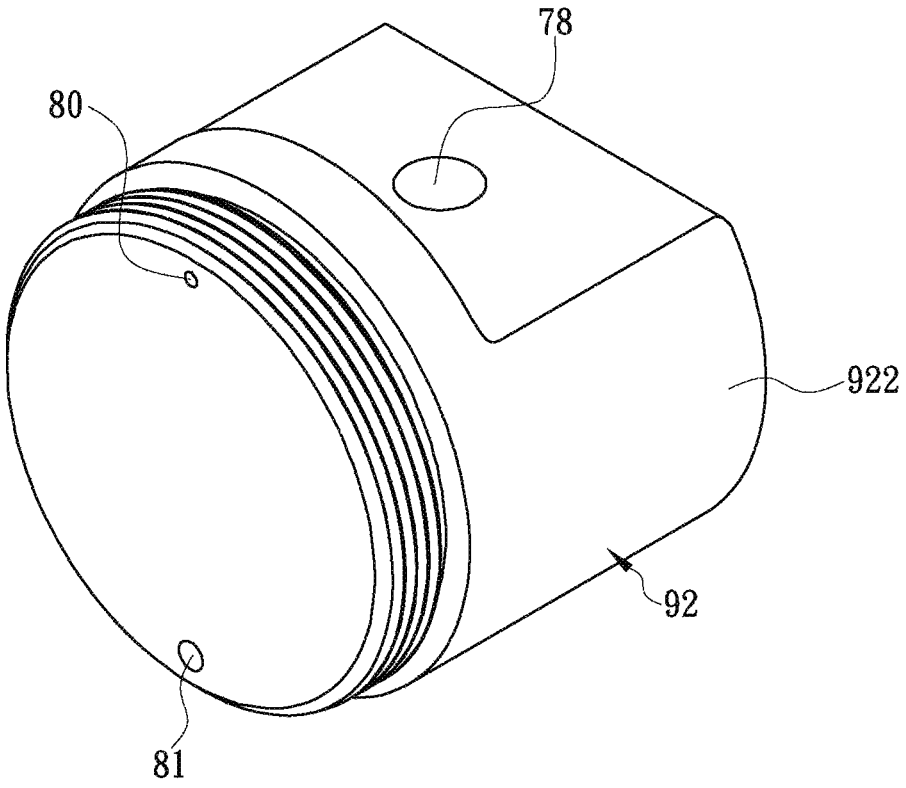
FIG. 5 is a perspective view of the coupler of the humidification apparatus of the present invention illustrated in FIG. 1.
Figure 6:
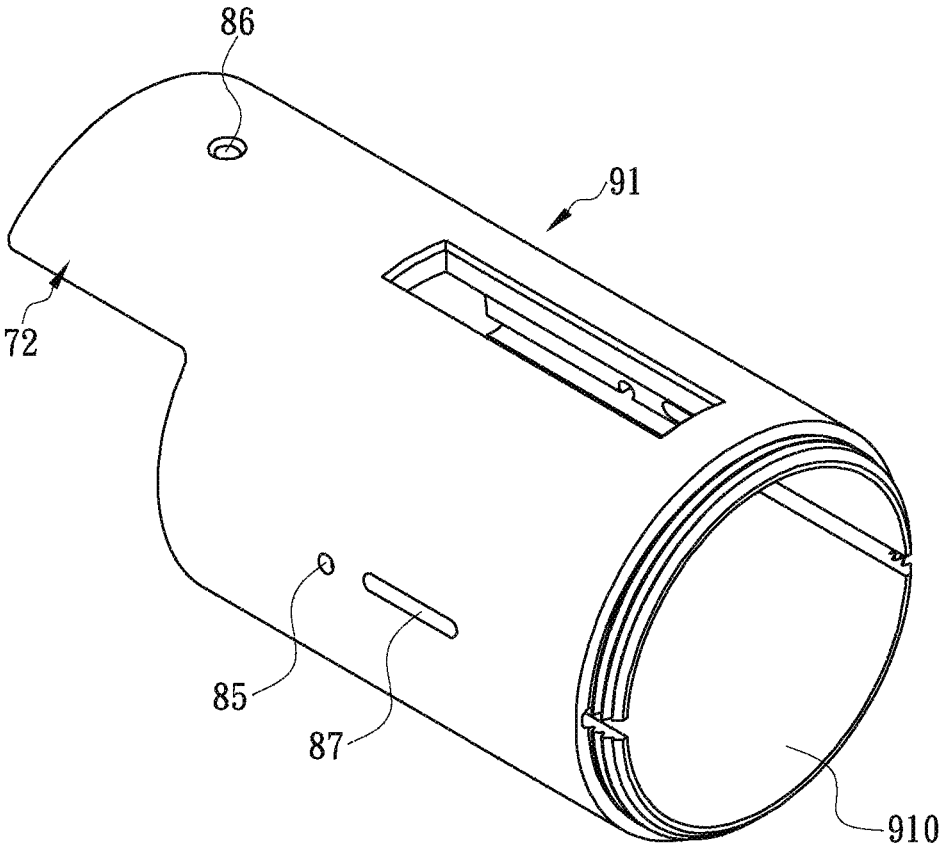
FIG. 6 a perspective view of the housing of the humidification apparatus of the present invention illustrated in FIG. 1.

In another preferred embodiment of the present invention, as referring to FIGS. 2, 3 and 4 the humidification apparatus (100) claimed in the present invention may comprise at least one high frequency transducer (82) that can be activated by the control circuitry (79) to produce the humidifying mist or vapor (HM), in response to the relative humidity detected by the humidity sensor, for increasing the relative humidity in the surrounding environment (SE) to the User preset and desired level. Generally speaking, the operation of the high frequency transducer (82) executed by the control circuitry (79) can be halted when the relative humidity detected by the humidity sensor is slightly higher than the desired level, and is reactivated when the detected relative humidity is slightly lower than the desired level. Thus, the high frequency transducer (82) is only needed to be periodically activated to maintain the detected relative humidity around the preset level until the water stored in the water reservoir (93) has been depleted or the humidification apparatus (100) is switched off, either manually by the User or automatically at the end of a preset period of time.

In still another embodiment of the present invention, as again referring to FIGS. 2, 3 and 4, the humidification apparatus (100) claimed in the present invention further comprises a cap (90), which can be removably coupled to the second end of the housing (91) corresponding to the second accommodating space (910) and has a mesh member (84) positioned within an opening (901) thereof for promoting air in the surrounding environment (SE) to flow to the inside of the housing (91) for being detected by the sensors installed inside the housing (91), the mesh member (84) is configured to be placed over the temperature and humidity sensors and for concealing the sensors visually and protecting the sensors disposed inside the housing (91) by providing a visually pleasant quality to the apparatus (100), while simultaneously providing an airflow passage to the concealed sensors for detecting the temperature and humidity statuses and the changes of the surrounding environment (SE) effectively. In one embodiment, openings on the mesh member (84) may be pinhole-like openings that are covering substantially over the entire face of the mesh member (84). In the other embodiment the mesh member (84) may be formed from a material such as a plastic or other non-metallic material.

In one embodiment, the aforementioned sensors may be conveniently disposed inside the housing (91), but the sensor may also be disposed outside the housing (91), for example, being disposed at an end of a cable having the other end connected to the control circuitry (87) and affixed to the outside body of the housing (91).

In an alternative embodiment of the present invention, the humidification apparatus (100) may include a wireless circuitry coupled to the control circuitry (79), wherein the wireless circuitry is configured to cooperate with the control circuitry (79) for being connected to a network or internet and allowing the other equipment connected to the network or internet to utilize the humidification apparatus (100) in various technological circumstances for effectively broadening the operation of the apparatus and offering a rich variety of additional capabilities.

Although the invention herein has been described by reference to a particular embodiment, it is to be understood that the embodiment is merely illustrative of the principles and application of the present invention. It is therefore to be understood that various modifications may be made to the above-mentioned embodiment and that other arrangements may be devised without departing from the scope of the present invention as defined by the appended claims.

What is claimed is:

1. A humidification apparatus comprising multiple interconnected segments that couple together to form an elongated body including:

a water reservoir, having an open end and a closed end opposite to the open end, and a first accommodating space formed therein between the two ends for receiving a volume of water;

a housing, having a second accommodating space formed therein; and including:

a humidity sensor and a temperature sensor disposed in the housing for sensing humidity and temperature values in a surrounding environment of the apparatus;

at least one power connector disposed in the housing for supplying power therethrough from a corresponding power source to electronic elements of the apparatus;

a high frequency transducer disposed inside the housing and capable of generating high frequency oscillation for atomizing water in contact therewith;

a control circuitry disposed in the second accommodating space, and electrically connected to the sensors, the power connector, and high frequency transducer respectively, and capable of activating the high frequency transducer to generate high frequency oscillation in response to the humidity or temperature value change detected by the sensors and to act as an atomizing device for producing humidifying mist or vapor; and a coupler having one end removably coupled to the open end of the water reservoir by means of a watertight connection, and another end removably coupled to the first end of the housing, and including an vertical passage, at least one horizontal passage, and a wicking element, wherein the vertical passage is formed in the coupler and configured to intersect with the horizontal passage; the horizontal passage is formed in the coupler and configured to create a continuously regulated flow of water from the first accommodating space to the vertical passage; and wherein, the top end of the vertical passage is able to communicate with the surrounding environment of the apparatus through an outlet formed on the housing; and the wicking element is inserted in the vertical passage with its lower end positioned within the coupler and corresponding to the intersection of the vertical passage and the horizontal passage for receiving the liquid flowing from the first accommodating space through the horizontal passage to the coupler, such that wicking element is able to continuously absorb said liquid and then consistently move said liquid upwards against gravity by the capillary action of the wicking element to the top end of the wicking element, so that the top end of the wicking element will be always maintained to be moistened while being in contact with the base of the high frequency transducer.

2. The apparatus of claim 1, wherein the another end of the coupler is removably coupled to a second end of the housing by means of a magnet and a magnetic material, or two magnets, capable of attracting together with each other.

3. The apparatus of claim 2, wherein the housing further includes a slot to guide the magnet into a fixed position when the housing is coupled to the coupler.

4. The apparatus of the claim 1, wherein the housing further includes a cap, which can be coupled to the second end of the housing and a mesh member is positioned within an opening of the cap corresponding to the second end of the housing for promoting air in the surrounding environment to flow into the second accommodating space and to be detected by the sensors installed inside the housing.

5. The apparatus of the claim 2, wherein the housing further includes a cap, which can be coupled to the second end of the housing and a mesh member is positioned within an opening of the cap corresponding to the second end of the housing for promoting air in the surrounding environment to flow into the second accommodating space and to be detected by the sensors installed inside the housing.

6. The apparatus of the claim 3, wherein the housing further includes a cap, which can be coupled to the second end of the housing and a mesh member is positioned within an opening of the cap corresponding to the second end of the housing for promoting air in the surrounding environment to flow into the second accommodating space and to be detected by the sensors installed inside the housing.

7. The apparatus of the claim 4, wherein the housing further includes an electronic display disposed on outside body of the housing for displaying digital numeric values of the identified setpoint values of humidity and temperature respectively.

8. The apparatus of the claim 5, wherein the housing further includes an electronic display disposed on outside body of the housing for displaying digital numeric values of the identified setpoint values of humidity and temperature respectively.

9. The apparatus of the claim 6, wherein the housing further includes an electronic display disposed on outside body of the housing for displaying digital numeric values of the identified setpoint values of humidity and temperature respectively.

10. The apparatus of the claim 7, wherein the housing further includes at least one User operable button disposed on outside body of the housing for allowing a User to set and adjust setpoint values of humidity and temperature as well as to provide an access to a selectable menu items shown on the electronic display.

11. The apparatus of the claim 8, wherein the housing further includes at least one User operable button disposed on outside body of the housing for allowing a User to set and adjust setpoint values of humidity and temperature as well as to provide an access to a selectable menu items shown on the electronic display.

12. The apparatus of the claim 9, wherein the housing further includes at least one User operable button disposed on outside body of the housing for allowing a User to set and adjust setpoint values of humidity and temperature as well as to provide an access to a selectable menu items shown on the electronic display.

13. The apparatus of claim 10, wherein the housing further includes a wire pass situated in the housing adjacent to the outlet, so as to allow one end of the transducer to be positioned inside the second accommodating space and connected to the control circuitry, and allow the other end of the transducer to extend to the top end of the vertical passage through the wire pass corresponding to the outlet and to be in contact with the top end of the wicking element.

14. The apparatus of claim 11, wherein the housing further includes a wire pass situated in the housing adjacent to the outlet, so as to allow one end of the transducer to be positioned inside the second accommodating space and connected to the control circuitry, and allow the other end of the transducer to extend to the top end of the vertical passage through the wire pass corresponding to the outlet and to be in contact with the top end of the wicking element.

15. The apparatus of claim 12, wherein the housing further includes a wire pass situated in the housing adjacent to the outlet, so as to allow one end of the transducer to be positioned inside the second accommodating space and connected to the control circuitry, and allow the other end of the transducer to extend to the top end of the vertical passage through the wire pass corresponding to the outlet and to be in contact with the top end of the wicking element.

16. The apparatus of claim 13, wherein the coupler further comprises at least one air passage formed and disposed on the first end of the coupler in communicating with the first accommodating space of the water reservoir.

17. The apparatus of claim 14, wherein the coupler further comprises at least one air passage formed and disposed on the first end of the coupler in communicating with the first accommodating space of the water reservoir.

18. The apparatus of claim 15, wherein the coupler further comprises at least one air passage formed and disposed on the first end of the coupler in communicating with the first accommodating space of the water reservoir.

19. The apparatus of claim 16, wherein the coupler further comprises an extruded lower end, and the housing further comprises an oppositely extruded upper end formed on the first end of the housing, so that the extruded lower end of the coupler can then be coupled and merged with the oppositely extruded upper end of the housing together to form a continuously circumferential elongated body, and allowing the upper end of the wicking element protruding out from the coupler through the vertical passage to be in contact with the base of the high frequency transducer installed in the housing at the position corresponding to the outlet formed on the oppositely extruded upper end of the housing, such that when the high frequency transducer is activated by the control circuitry, in response to the humidity or temperature values changes detected by the sensors, to generate the high frequency oscillation and, in the meantime, apply the high frequency oscillation to the liquid contained in the upper end of the wicking element, the liquid will be atomized to produce humidifying mist or vapor and be dispersed through the outlet out to the surrounding environment.

20. The apparatus of claim 17, wherein the coupler further comprises an extruded lower end, and the housing further comprises an oppositely extruded upper end formed on the first end of the housing, so that the extruded lower end of the coupler can then be coupled and merged with the oppositely extruded upper end of the housing together to form a continuously circumferential elongated body, and allowing the upper end of the wicking element protruding out from the coupler through the vertical passage to be in contact with the base of the high frequency transducer installed in the housing at the position corresponding to the outlet formed on the oppositely extruded upper end of the housing, such that when the high frequency transducer is activated by the control circuitry, in response to the humidity or temperature values changes detected by the sensors, to generate the high frequency oscillation and, in the meantime, apply the high frequency oscillation to the liquid contained in the upper end of the wicking element, the liquid will be atomized to produce humidifying mist or vapor and be dispersed through the outlet out to the surrounding environment.

21. The apparatus of claim 18, wherein the coupler further comprises an extruded lower end, and the housing further comprises an oppositely extruded upper end formed on the first end of the housing, so that the extruded lower end of the coupler can then be coupled and merged with the oppositely extruded upper end of the housing together to form a continuously circumferential elongated body, and allowing the upper end of the wicking element protruding out from the coupler through the vertical passage to be in contact with the base of the high frequency transducer installed in the housing at the position corresponding to the outlet formed on the oppositely extruded upper end of the housing, such that when the high frequency transducer is activated by the control circuitry, in response to the humidity or temperature values changes detected by the sensors, to generate the high frequency oscillation and, in the meantime, apply the high frequency oscillation to the liquid contained in the upper end of the wicking element, the liquid will be atomized to produce humidifying mist or vapor and be dispersed through the outlet out to the surrounding environment.

22. The apparatus of claim 19, wherein each of the passages has a diameter no less than 0.5 mm.

23. The apparatus of claim 20, wherein each of the passages has a diameter no less than 0.5 mm.

24. The apparatus of claim 21, wherein each of the passages has a diameter no less than 0.5 mm.

25. The apparatus of claim 22, wherein the high frequency transducer can be operated at a frequency in the range of 40 KHz to 500 KHz.

26. The apparatus of claim 23, wherein the high frequency transducer can be operated at a frequency in the range of 40 KHz to 500 KHz.

27. The apparatus of claim 24, wherein the high frequency transducer can be operated at a frequency in the range of 40 KHz to 500 KHz.

28. The apparatus of claim 25, wherein the high frequency transducer is disposed within a cavity disposed within the oppositely extruded upper end of the housing so that the top end of the wicking element can be in contact with the base of the high frequency transducer.

29. The apparatus of claim 26, wherein the high frequency transducer is disposed within a cavity disposed within the oppositely extruded upper end of the housing so that the top end of the wicking element can be in contact with the base of the high frequency transducer.

30. The apparatus of claim 27, wherein the high frequency transducer is disposed within a cavity disposed within the oppositely extruded upper end of the housing so that the top end of the wicking element can be in contact with the base of the high frequency transducer.

31. The apparatus of claim 28, further includes a battery disposed inside the housing for supplying power to the apparatus through the corresponding power connector.

32. The apparatus of claim 29, further includes a battery disposed inside the housing for supplying power to the apparatus through the corresponding power connector.

33. The apparatus of claim 30, further includes a battery disposed inside the housing for supplying power to the apparatus through the corresponding power connector.

34. The apparatus of claim 28, further includes an external power source disposed outside the housing for supplying power to the apparatus through the corresponding power connector.

35. The apparatus of claim 29, further includes an external power source disposed outside the housing for supplying power to the apparatus through the corresponding power connector.

36. The apparatus of claim 30, further includes an external power source disposed outside the housing for supplying power to the apparatus through the corresponding power connector.

37. The apparatus of claim 28, further includes a wireless charging element for charging the battery through resonant inductive coupling.

38. The apparatus of claim 29, further includes a wireless charging element for charging the battery through resonant inductive coupling.

39. The apparatus of claim 30, further includes a wireless charging element for charging the battery through resonant inductive coupling.

40. The apparatus of claim 28, further includes a wireless circuitry for wirelessly transmitting the humidity and temperature or other air quality measurent values of the surrounding environment detected by the sensors directly to a remote apparatus or indirectly to a remote apparatus through a network or internet.

41. The apparatus of claim 29, further includes a wireless circuitry for wirelessly transmitting the humidity and temperature or other air quality measurent values of the surrounding environment detected by the sensors directly to a remote apparatus or indirectly to a remote apparatus through a network or internet.

42. The apparatus of claim 30, further includes a wireless circuitry for wirelessly transmitting the humidity and temperature or other air quality measurent values of the surrounding environment detected by the sensors directly to a remote apparatus or indirectly to a remote apparatus through a network or internet.

* * * * *